US005735090A

United States Patent [19]

Papke

[11] Patent Number: 5,735,090

[45] Date of Patent: Apr. 7, 1998

[54] MODULAR FOUNDATION CONSTRUCTION AND METHOD

[76] Inventor: William Papke, 2645 Lake Edge La., N.E., Grand Rapids, Mich. 49505

[21] Appl. No.: 512,444

[22] Filed: Aug. 8, 1995

[51] Int. Cl.[6] ..... E04B 2/86

[52] U.S. Cl. ..... 52/220.2; 52/309.8; 52/406.1; 52/439; 52/442; 52/592.3

[58] Field of Search ..... 52/439, 505, 220.2, 52/592.2, 592.3, 220.3, 437, 438, 606, 607, 405.3, 405.1, 442, 309.8, 406.1, 404.1; 174/68.3, 70 C; 439/207, 210, 211, 215

[56] References Cited

U.S. PATENT DOCUMENTS

| | | | |
|---|---|---|---|
| 312,305 | 2/1885 | Trumbull | 52/439 |
| 708,499 | 9/1902 | Searight et al. | 52/592.3 |
| 791,775 | 6/1905 | Hansell . | |
| 792,979 | 6/1905 | Fulghum | 52/592.2 |
| 945,859 | 1/1910 | Neuberger | 52/592.3 |
| 1,369,296 | 2/1921 | Painter . | |
| 1,562,340 | 11/1925 | Kiss . | |
| 1,704,255 | 3/1929 | Lewis . | |
| 1,836,408 | 12/1931 | Sutton | 52/220.2 |
| 2,054,679 | 9/1936 | Nelson . | |
| 2,172,051 | 9/1939 | Robbins . | |
| 2,172,052 | 9/1939 | Robbins . | |
| 2,172,053 | 9/1939 | Robbins | 52/438 |
| 2,611,261 | 9/1952 | Preston | 52/505 |
| 2,902,853 | 9/1959 | Lofstrom | 52/505 |
| 3,055,460 | 9/1962 | Maroney . | |
| 3,449,878 | 6/1969 | Hern . | |
| 3,593,480 | 7/1971 | Bouchillon . | |
| 3,662,507 | 5/1972 | Espeland . | |
| 3,685,241 | 8/1972 | Cooper . | |
| 4,004,385 | 1/1977 | Kosuge . | |
| 4,151,239 | 4/1979 | Ogden . | |
| 4,263,765 | 4/1981 | Maloney . | |
| 4,288,962 | 9/1981 | Kavanaugh . | |
| 4,290,246 | 9/1981 | Hilsey . | |
| 4,295,810 | 10/1981 | Dennert et al. . | |
| 4,380,887 | 4/1983 | Lee | 52/505 |
| 4,453,357 | 6/1984 | Zwilgmeyer . | |
| 4,514,949 | 5/1985 | Crespo . | |
| 4,903,450 | 2/1990 | Adams . | |
| 5,247,773 | 9/1993 | Weir | 52/592.3 |
| 5,311,712 | 5/1994 | Accousti . | |
| 5,311,718 | 5/1994 | Trousilek . | |
| 5,336,849 | 8/1994 | Whitney . | |
| 5,367,845 | 11/1994 | Hartling . | |
| 5,425,210 | 6/1995 | Zafir . | |

FOREIGN PATENT DOCUMENTS

| | | |
|---|---|---|
| 2070079 | 11/1993 | Canada . |
| 0174650 | 11/1986 | European Pat. Off. . |
| 2608027 | 2/1904 | Germany . |
| 2632040 | 2/1926 | Germany . |

OTHER PUBLICATIONS

Exhibit A is a product brochure entitled "The Royal Housing System"; Published by Royal Plastics Group; Copyright 1992 which discloses a housing system including extruded parts.

*Primary Examiner*—Michael Safavi
*Attorney, Agent, or Firm*—Price, Heneveld, Cooper, DeWitt & Litton

[57] ABSTRACT

The present modular foundation construction includes a plurality of interconnectable extruded modular forms configured to be selectively arranged and interconnected in the shape of a customized building foundation. The plurality of forms, when the shape of the customized foundation, define a series of interconnected first cavities extending around the shape for receiving poured concrete and further include a series of second cavities extending along the first cavities filled with insulation to form a substantially continuous insulative layer around the shape. Male and female connectors on the end wall sections of the forms provide a secure interconnection. A method includes extruding the modular forms, filling the second cavities with insulative material, shipping the extruded modular forms to a construction site, assembling the modular forms in the desired customized building foundation shape, positioning reinforcement bars and/or utility-carrying tubes along the shape, and pouring concrete into the first cavities of the assembled modular foundation construction.

29 Claims, 3 Drawing Sheets

MODULAR FOUNDATION CONSTRUCTION AND METHOD

BACKGROUND OF THE INVENTION

The present invention concerns building foundations, and more particularly concerns a modular foundation construction including a plurality of modular units configured to be interconnected in customized configurations.

Conventional construction techniques for building foundations, such as pouring concrete or laying concrete blocks, require a considerable amount of skilled and unskilled labor, both in constructing the walls of the foundations per se and in treating/covering the walls after they have been constructed. Poured concrete basements in particular are known to be damp, dark in color, rough in shape, and poorly insulated. Also, a significant amount of the time and cost is used constructing forms for receiving poured concrete or is used in laying cement blocks. Further, in both poured and block foundations, the constructed walls must be sealed with a moisture resistant material and then covered with insulation. For example, the State of Michigan now requires that basements have an insulative value of "R11".

A known housing system produced by Royal Plastics, disclosed in the materials attached hereto, utilizes hollow extruded components that are slidably interconnectable to form a wall adapted to receive poured concrete. The components include opposing finger-like flanges positioned at the corners of one longitudinal edge that are configured to mateably engage channels proximate the corners of another longitudinal edge. However, while positioning the flanges at corners make the flanges more accessible, it also exposes the flanges to damage during shipping and handling, particularly at the construction site. Further, in the event that the finger-like flanges warp or become damaged or if the receiving channels become partially filled, the finger-like flanges will be forced apart during assembly, such that the flanges may not fully seat in the channels. In such case, adjacent components are not held together with a positive connecting force. Further, unseated and warped flanges cause the wall to look non-uniform and unprofessional. Additionally, no provision is made for incorporating a layer of insulating material into the illustrated components.

Thus, a foundation constructing system is desired that is insulated and that facilitates a quick and secure on-site construction with damage-resistant and positively interlocking modular forms requiring minimal skilled labor and reduced need for heavy manual labor.

SUMMARY OF THE INVENTION

The present invention includes an apparatus for forming customized building foundations. The apparatus includes a plurality of extruded modular forms configured to be selectively arranged in the shape of a customized building foundation. The plurality of forms, when in the shape of the customized building foundation, define a series of interconnected first cavities extending around the shape for receiving poured concrete and further include a series of second cavities extending generally adjacent to the first cavities for receiving insulation to form a substantially continuous insulative layer around the shape. In one aspect, the second cavities are filled with insulation when manufactured, thus providing optimal control and efficiency of the insulation adding operation. Further, the second cavities are positioned along the exterior of the foundation. In another aspect, the modular forms are provided with connectors that are positioned in a damage-resistant location on end wall sections and are constructed to provide a positive connection in spite of any linear nonuniformity or deformation that may be present. In yet another aspect, apertures are provided in the modular forms for interconnecting the first cavities, which apertures allow cross-flow of poured cement. The uppermost apertures also allow utility-carrying pipes and/or reinforcement bars to be laid into position within the foundation construction.

The present invention further includes a method of constructing building foundations including steps of providing a plurality of modular forms each including wall sections defining substantially continuous first and second parallel cavities when arranged in the shape of a building foundation. The method further includes arranging the modular forms in the shape of a building foundation, and filling the first and second cavities with insulating material and poured concrete, respectively. In a preferred method, the first cavities are filled with insulating material at a manufacturing facility, and the modular forms are then shipped to the job site for assembly and filling with concrete. Preferably, the first cavities are positioned along the exterior of the building foundation.

These and other features, advantages and objects of the present invention will be further understood and appreciated by those skilled in the art by reference to the following specification, claims and appended drawings.

DETAILED DESCRIPTION OF PREFERRED EMBODIMENT

Figure 1:
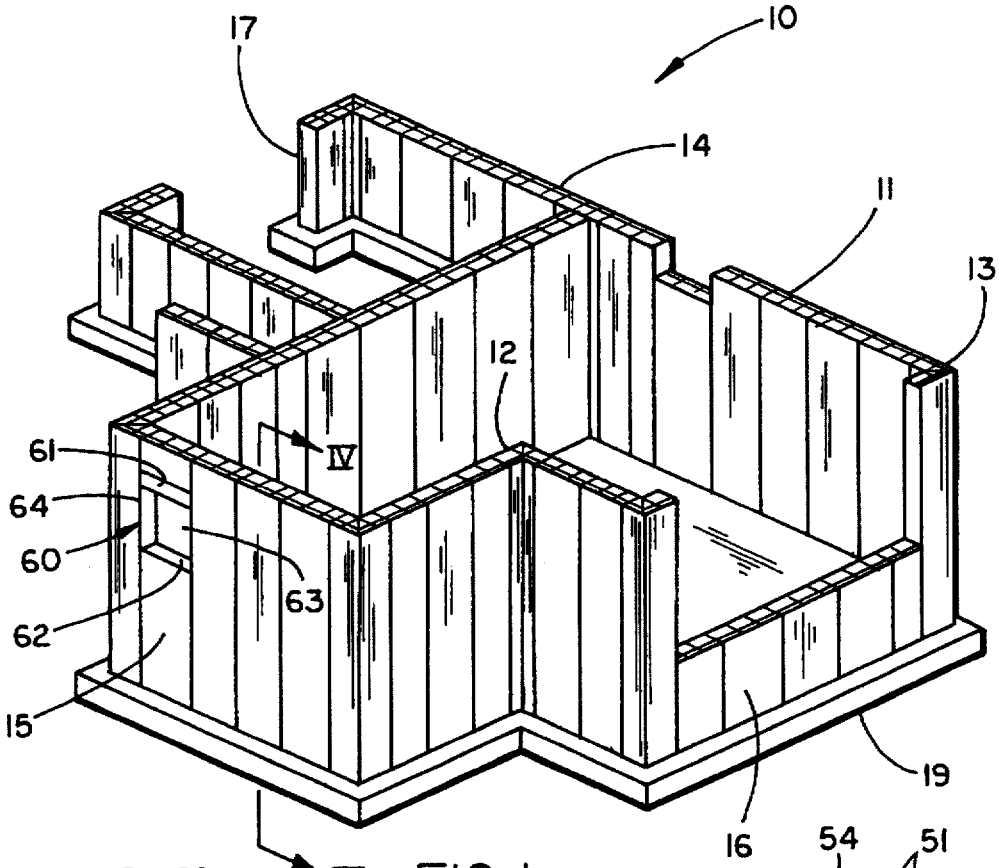
FIG. 1 is a perspective view of the customized building foundation embodying the present invention, the building foundation including a plurality of modular forms assembled together and positioned on a footing in the shape of a customized building foundation.

A customized building foundation 10 (FIG. 1) is constructed using a foundation system that includes a plurality of interconnected extruded modular forms, such as modular forms 11–18 (FIGS. 1 and 8), that can be selectively arranged and interconnected on a footing 19 (FIG. 1). The modular forms 11–18 are pre-insulated, but are filled with wet, pourable concrete on the construction site to form a permanent insulated building foundation or wall structure for a house or building. The modular forms are configured to form substantially all corners, windows, joints, and other shaped wall sections for a building foundation construction. Advantageously, the foundation system of modular forms can be readily constructed on site with unskilled labor. The foundation system provides a sealed, insulated and complete foundation construction that meets all building codes and is suitable to live in without further treatment, but further includes wall surfaces that are ready to receive further coverings such as paneling, paint or the like.

Figure 7:
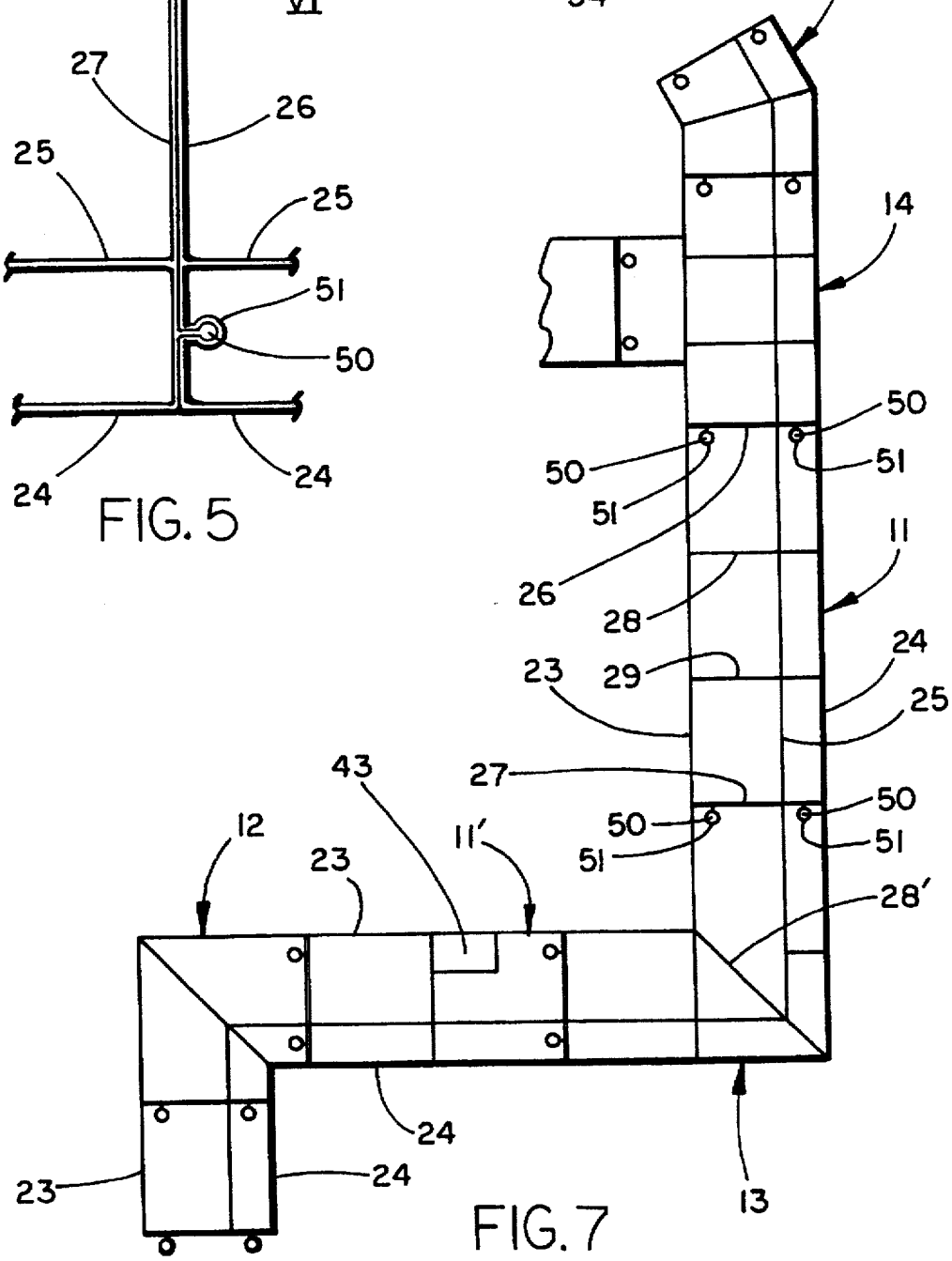
FIG. 7 is a fragmentary plan view of a customized building foundation similar to that shown in FIG. 1.

The modular forms 11–18 provide a variety of shapes having common features that facilitate their interconnection and use as described below. The illustrated shapes include a straight section modular form 11 (FIG. 1), an L-shaped inner corner modular form 12, an L-shaped outer corner modular form 13, a T-shaped wall joining modular form 14, a window defining modular form 15, a bay-window-defining short-height modular form 16, a wall-ending modular form 17, and an obliquely angled wall section modular form 18 (FIG. 7). However, though particular shapes are shown, it is contemplated that a variety of different modular forms can also be constructed, such as X-shaped, Y-shaped, and Z-shaped modular forms.

Figure 2:
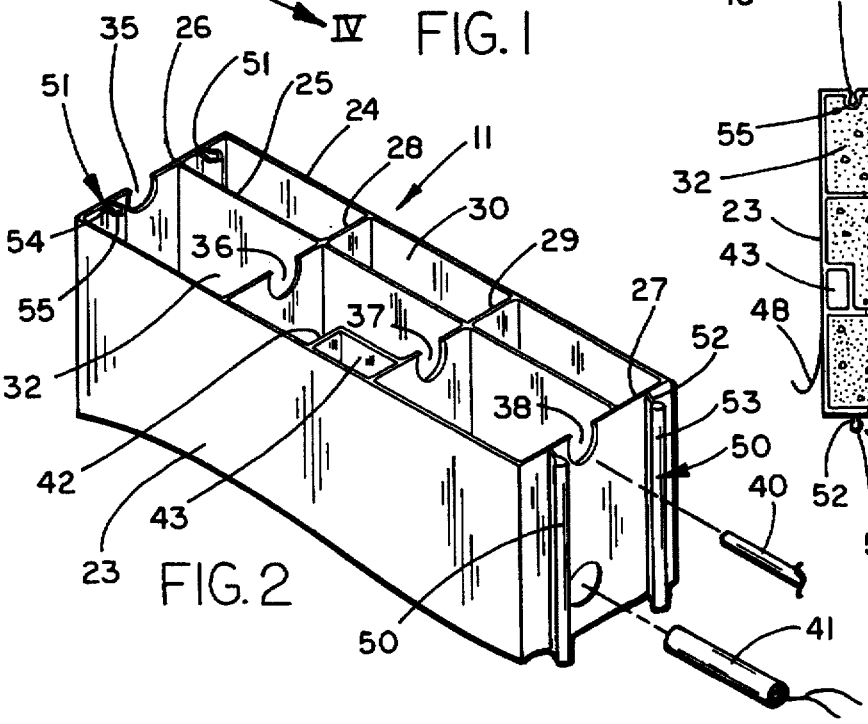
FIG. 2 is a fragmentary perspective view of a selected modular form shown in FIG. 1.
Figure 3:
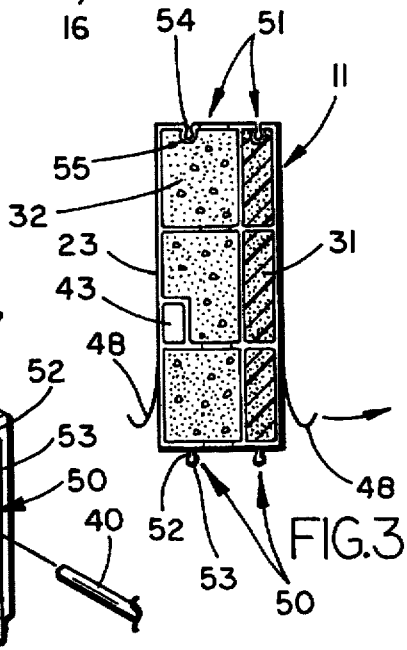
FIG. 3 is a plan view of the modular form shown in FIG. 2, the modular form being filled with insulating foam along one side and cement along the other side.

The modular form 11 (FIG. 2) is exemplary of many common features found in modular forms 11–18. It is to be understood that the concepts found in modular form 11 are incorporated into the other modules 12–18 as desired. Modular form 11 (FIG. 2) is an extrusion of PVC or other structural polymeric material. Modular form 11 includes a matrix of wall sections including an inner wall section 23, an other wall section 24, and an intermediate wall section 25, each of wall sections 23–25 being parallel and interconnected by opposing end wall section 26 and 27 and intermediate transverse reinforcing wall sections 28 and 29. Notably, the number, thickness and location of intermediate wall sections can be varied depending on the width, height, and depth of the respective modular forms. For example, higher/taller modular forms will require increased wall thickness or reinforcement/strength due to the hydraulic pressure of wet, poured concrete. Also, the intermediate walls can be oriented for optional structural integrity. For example, L-shaped modular form 13 includes an angled intermediate wall 28' (FIG. 7). Outer wall section 24 and intermediate wall section 25 define a cavity 30 therebetween adapted to be filled with a foamed-in-place polyurathane foam 31 (FIG. 3) or other insulative material. The foam 31, in addition to forming a thermal insulating barrier, also adds strength and structure to the modular form 11. The foam 31 can be added on site, but preferably as applied at the manufacturing facility to allow optimal control and efficiency. For example, it is contemplated that the foam can be added as part of an extruding process in a continuous operation. The insulating value provided by the modular forms 11–18 including foam 31 can be substantially any "R" insulating value desired. For example, an "R-11" insulating value is now required for foundations of new buildings for the state of Michigan. The cavity 32 defined between inner wall section 23 and intermediate wall section 25 is configured to be filled with poured concrete 33 as described below.

Mating male and female connectors 50 and 51 are positioned on end wall section 26 and 27 respectively. Connectors 50 and 51 extend the full length of modular forms 11–18, and are configured to positively interlockingly slidably engage to prevent undesired separation. Specifically, male connector 50 includes a root or stem 52 having a relatively narrow dimension, and an enlarged cylindrically shaped head 53. Female connector 51 includes a necked or narrow inlet 54 for receiving stem 52 and an enlarged pocket 55 for receiving head 53. The arrangement assures a positive connection and resists damage to components since the female connector 51 is recessed in a protected position and since the head 53 of male connector 50 is blunted and includes sufficient material to resist damage. Further, male connector 50 (and also female connector 51) are spaced from side wall sections 23 and 24. This positions connector 50 away from the side of the modular form, which reduces the likelihood of damage during transport and handling of the modular forms. Notably, the mating shapes of the connectors 50 and 51 facilitates their secure and positive assembly even if there is some longitudinal warpage or deformation to connectors 50 and 51 since the male connector 50 is snaked into the female connector 51 during assembly of the modular forms. Two pairs of connectors 50 and 51 are shown spaced along end walls 26 and 27, although it is contemplated that additional connectors can be added if desired.

Modular form 11 includes a plurality of apertures 35, 36, 37, and 38 in wall sections 26–29, respectively, that allow fluid concrete to flow between adjacent concrete-holding cavities 32 in a given modular form and between adjacent modular forms. This assures that air escapes and that the cavities 32 are completely filled as concrete is poured. It further prevents the concrete from developing a non-uniform hydraulic pressure capable of undesirably stressing and deforming wall sections as the concrete is poured into a particular concrete-holding cavity 32. Notably, the cross-flow of concrete through apertures 35–38 is important since the hydraulic pressure of wet concrete can be considerably at the base of the modular forms. Advantageously, because of apertures 35–38, the wall section thicknesses can be reduced such that a lighter weight and lower cost module can be constructed. Also, a reinforcement bar 40 or tubular utility-carrying pipe 41 (for carrying electrical wires, telephone lines, gas lines, etc) can be extended horizontally through apertures 35–38. The uppermost apertures 35–38 are located at the tops of walls sections 26–29 and are upwardly open such that a reinforcement bar can be simply laid into the top apertures from above. The reinforcement bar 40 reinforces the construction 10 once the concrete solidifies. The poured concrete forms a key 66 (FIG. 4) that engages a keyway 67 in the footing 55.

Several of modular forms 11–18 also can include secondary wall sections 42 forming a vertical raceway space 43. In the illustrated modular form 11 shown in FIG. 2, secondary wall sections 42 extend from inner wall section 23 and transverse wall section 29 to define a vertically extending raceway space 43. Notably, the raceway space can be located substantially anywhere within the modular form as long as it does not interfere with items being extended through apertures 35–38. It is contemplated that utility-carrying pipe 41 will be extended along side secondary wall section 42 or through the secondary wall 42 so that a connection can be made from raceway space 43 to the utilities within pipe 41. In a modified version of modular form 11 (FIG. 8), a pair of opposing longitudinally-extending concave ridges or first connectors 44 are formed along the inner surfaces of inner wall section 23 to mateably engage corresponding lips or second connector 44' on an insert/secondary wall section 42'. The illustrated modular forms 11–18 are generally symmetrical from end to end to facilitate manufacture and also assembly by unskilled labor. However, the forms need not be symmetrical.

Figure 8:
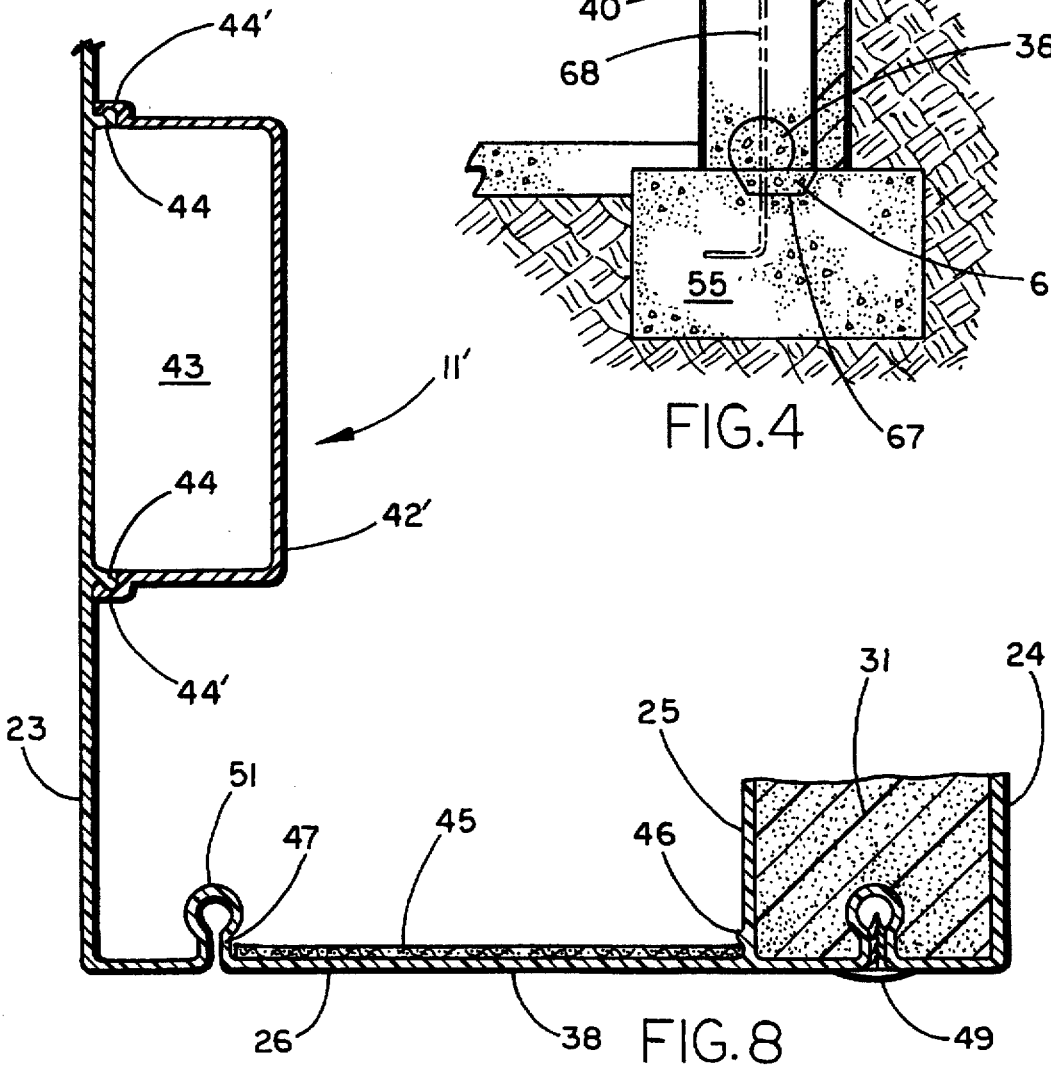
FIG. 8 is a fragmentary plan view of a modified modular form.
Figure 5:
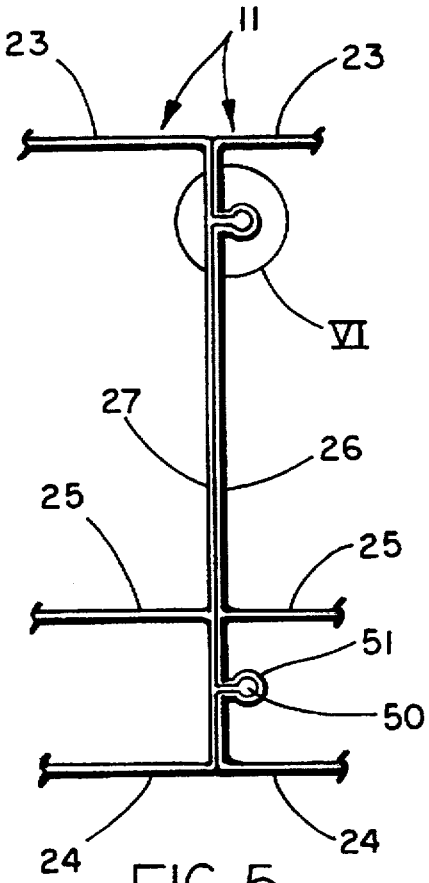
FIG. 5 is an enlarged fragmentary view showing abutting end wall sections on adjacent modular forms including an interconnected pair of male and female connectors.
Figure 6:
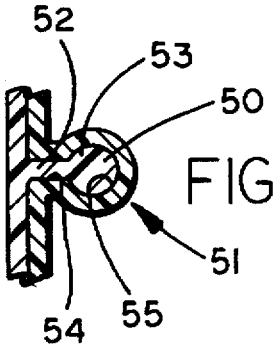
FIG. 6 is an enlarged fragmentary view of the circled are VI in FIG. 5.

Modular form 17 (FIG. 1), located at an end of a foundation wall, includes a continuous end wall section on its exposed end that does not have apertures. The absence of apertures is necessary so that wet concrete does not flow out of the end walls during construction of the foundation as concrete is poured into the cavities 32. Alternatively, modular forms may include apertured end wall sections as long as the apertures 35 are covered at the exposed end wall section. In FIG. 8, a planar panel 45 is positioned on the inside of end wall 26 over apertures 38. Planar panel 45 is held in place by a ridge 46 formed on intermediate wall section 25 and by the convex surface 47 at the root of the female connector 51. Alternatively, planar panel 45 can be held in place by the hydraulic pressure of the wet concrete alone.

Additional features are provided on the modular forms or for use with the modular forms for aesthetics. A strip of peel-off protective paper 48 (FIG. 3) is releasably adhered to the inner and/or outer surfaces of inner and outer wall sections 23 and 24. Paper 48 can be readily peeled away and disposed of once the construction of foundatin 10 is complete. Paper 48 prevents concrete from adhering to the visible surfaces of wall sections 23 and 24, such as when concrete spills over the top of the modular forms, and further absorbs nicks, cuts and other light abrasions that often occur during construction. It is contemplated that any unused female connectors 51 can be filled with a filler material, or a trim strip 49 (FIG. 8) can be pressed into position. Visible male connectors 50 can be cut away, or covered with a trim strip including a mating female connector. It is further contemplated that auxiliary items can be attached to the connectors, such as lamps, flower pots, and the like.

Windows can be cut into an assembly of modular forms as desired. The windows would be framed-in before pouring the concrete. Alternatively, the modular form 15 (FIG. 1) can be used. Modular form 15 includes a window module 60 having a top, bottom, and side members 61–64, respectively, can be used. Side members 63 and 64 include male and female connectors for mateably engaging female and male connectors on adjacent modular forms. Bottom member 62 is configured to sealingly engage the top of the foreshortened modular form onto which it is positioned, and the top member 61 is configured to sealingly engage and support the bottom of the modular form that is placed above it. The sealing engagement can be achieved by overlapping wall sections, by use of a gasketing material or foam, and the like. However, it is noted that care must be used to assure that the modular form below the window module 60 completely fills with concrete.

Figure 4:
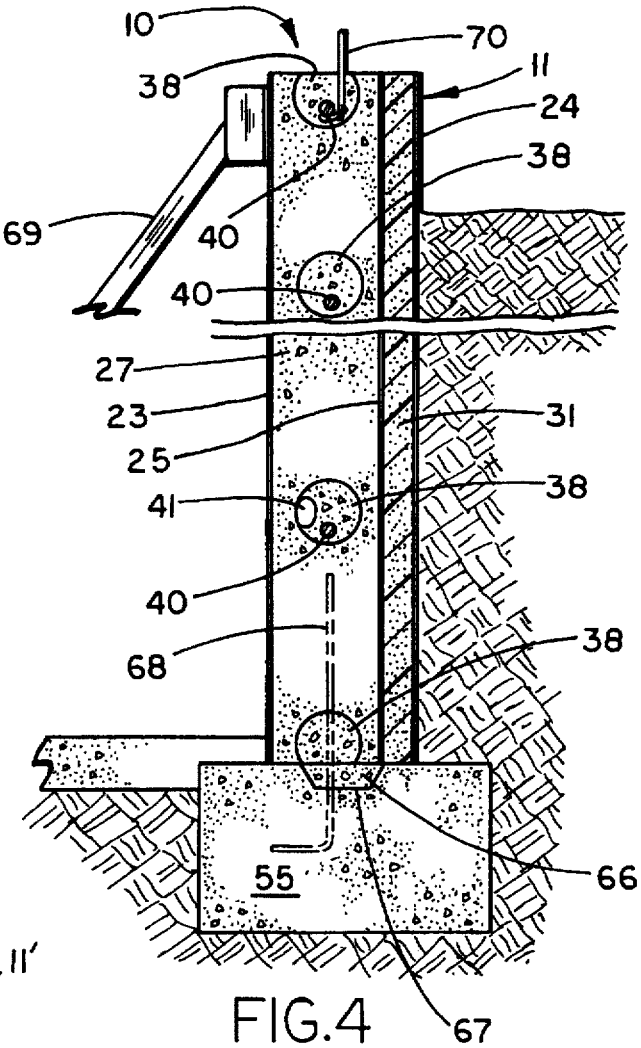
FIG. 4 is a cross sectional view taken along the plane IV—IV in FIG. 1.

A foundation is construction using the apparatus 10 as follows. Initially a construction sight is prepared such as by digging a basement space into the ground and by pouring a footing 55 (FIG. 4). In a separate location at a manufacturing facility, various module forms, such as a correct number of modular forms 11–18 are extruded and filled with foam insulation and inventoried as desired. Notably, the modular forms can be construed to include desired colors in the inner and outer wall sections 23 and 24 and further can be coextruded of different materials as desired to minimize material expense of the extruded polymers. For example, the outer surface 24 would be a grey color similar to concrete, while the interior surface 23 would be an off-white color for a light appearance. Further, the visible surfaces of inner and outer wall sections 23 and 24 can be textured as desired such as to simulate brick, vinyl siding, wood siding, wood paneling, and the like. Optimally, a removable protective paper 48 is applied to the visible surfaces of inner and outer wall sections 23 and 24 to reduce damage to surfaces during shipping and handling, and during storage on the construction site. The modular forms 11–18 are then shipped to the construction site, precut to the desired length.

Footing 55 is prepared with a sealing viscous material or putty, and modular forms are interconnected and arranged on the footing 55 in the shape of the customized building foundation desired. The connectors 50 and 51 are coated with a sealant/adhesive material to provide a secure and positive interconnection, and then are slidably assembled as the modular forms are positioned on footing 55 with the reinforcing rods 68 extending upwardly from the footing into cavity 32 of the modular forms. The foundation construction of assembled modular forms 11–18 is braced using conventional bracing such as braces 69 to prevent the assembled modular forms from being accidentally or inadvertently knocked out of position while concrete is being poured. Further, sufficient bracing will allow persons to walk along a board placed on the top of the assembled apparatus 10. Anchor bolts 70 are set into the wet concrete or wired to reinforcing rod 40 at the top of the wall to facilitate anchoring of a wood sill plate for construction of the balance of the structure. Reinforcement bars 40 and utility carrying pipes 41 are located within apertures 35–38 and also vertical raceways are connected to the pipes 41 as desired. Concrete 33 is then poured into concrete retaining cavity 32. The concrete is allowed to solidify and construction of the building proceeds accordingly. Once the wall building construction is sufficiently complete such that the modular apparatus 10 is not likely to be damaged, the protective paper 48 is removed to reveal a first class undamaged visible wall surface. Notably, no additional treatment of the foundation construction 10 is required to meet building code requirements. In particular, the foundation construction 10 is water proof and insulated, and does not need to have moisture-resistant sealing material nor additional insulation applied thereto. Further, the visible wall surfaces are finished, without need for additional preparation of the inner and outer wall sections 23 and 24 unless so desired.

Accordingly, an apparatus for forming a customized building foundation is provided that includes a plurality of extruded modular forms configured to be selectively arranged in the shape of a customized building foundation. The plurality of forms, when in the shape of a customized building foundation, define a series of interconnected first cavities extending around the shape for receiving poured concrete and further include a series of second cavities filled with insulation for forming an insulating barrier around the shape. In the foregoing description, it will be readily appreciated by those skilled in the art that modifications may be made to the invention without departing from the concepts disclosed herein. Such modifications are to be considered as covered by the following claims, unless these claims by their language expressly state otherwise.

The embodiments of the invention in which an exclusive property or privilege is claimed are defined as follows:

1. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape, said plurality of modular forms include opposing end wall sections having apertures therein configured to allow cross flow of the cement being poured between the first cavities, wherein several of said plurality of modular forms extend vertically and include a first length substantially equal to a height of the customized building foundation and others of said plurality of modular forms have a lesser length, and including an aperture-covering member for covering the apertures to prevent the flow of concrete from the modular forms having the first length into and out of the modular forms having the lesser length.

2. The apparatus defined in claim 1 wherein the forms comprise extruded polymeric material.

3. A modular form foundation system comprising:

a plurality of interconnectable extruded forms including different cross sectional shapes configured so that said forms can be selectively arranged and interconnected on a construction site to define a customized building foundation shape, said plurality of forms each including an interior side wall section, an exterior side wall section, and opposing end wall sections interconnecting the side wall sections defining cavities that extend along the foundation shapes when assembled, said end wall sections including mating male and female interlocking connectors spaced from said side wall sections, wherein several of said plurality of forms extend vertically and include a first height substantially equal to a height of the customized building foundation shape and others of said plurality of forms have a lesser length, and including an aperture covering member for covering the apertures to prevent the flow of concrete from the forms having the first length into and out of the modular forms having the lesser length.

4. A modular form foundation system as defined in claim 3, wherein at least one of said apertures are located at a top of said end wall sections and open upwardly such that at least one aperture is accessible vertically for receiving a horizontally extending component.

5. A modular form foundation system as defined in claim 4, wherein at least another of said apertures are located at a bottom of said end wall sections.

6. The modular form defined in claim 3 wherein the forms comprise extruded polymeric material.

7. A modular form foundation system comprising:

a plurality of interconnectable extruded forms including different cross sectional shapes configured so that said forms can be selectively arranged and interconnected on a construction site to define a customized building foundation shape, said plurality of forms each including an interior side wall section, an exterior side wall section, and opposing end wall sections interconnecting the side wall sections defining cavities that extend along the foundation shapes when assembled, said end wall sections including mating male and female interlocking connectors spaced from said side wall sections; and a single-piece raceway defining insert configured to fit vertically within one of said cavities for defining an electrical raceway, said insert having longitudinally extending first connectors and said plurality of forms having second connectors positioned in said first cavities for engaging the first connectors to secure the insert in a selected position in a selected one of the first cavities.

8. A modular form foundation system as defined in claim 7, wherein said plurality of forms includes at least one straight modular form, at least one L-shaped corner modular form and at least one T-shaped modular form.

9. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape, said plurality of modular forms include opposing end wall sections having apertures therein configured to allow cross flow of the cement being poured between the first cavities; and an insert configured to fit within said first cavities against one of said opposing end wall sections for covering at least one of said apertures.

10. An apparatus as defined in claim 9 including foamed-in-place insulating material filling said second cavities.

11. An apparatus as defined in claim 10 wherein each of said modular forms includes a male connector on one end and a female connector on another end for mateably interlockingly engaging the male connector on an adjacent modular form.

12. An apparatus as defined in claim 11 wherein each of said plurality of modular forms includes an exterior side wall section, an interior side wall section, and opposing end wall sections interconnecting the side wall sections, one of said opposing end wall sections including a pair of said male connectors and the other of said opposing end wall sections including a pair of said female connectors.

13. An apparatus as defined in claim 12 wherein said connectors are covered with a sealant so that said connectors form a water proof barrier without a need for further treatment or coatings.

14. An apparatus as defined in claim 11 wherein said male connector includes a stem and further includes an enlarged head connected to said stem and spaced from the end wall to which it is connected, and said female connector includes a neck and an enlarged pocket for receiving said stem and said enlarged head, respectively.

15. An apparatus as defined in claim 11 including filler means configured to mateably engage one of said female connectors for covering same.

16. The apparatus defined in claim 9 wherein the forms comprise extruded polymeric material.

17. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape, said plurality of modular forms include opposing end wall section, with each end wall section having at least three apertures therein configured to allow cross flow of the cement being poured between the first cavities, wherein at least one of said apertures is truncated at an edge of said opposing said end wall sections so as to open upwardly such that the apertures are accessible vertically for receiving a horizontally extending component when the forms are arranged and interconnected in the shape of a building foundation.

18. The apparatus defined in claim 17 wherein the forms comprise extruded polymeric material.

19. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape; and a single-piece raceway-defining insert configured to fit vertically within one of said first cavities for defining an electrical raceway therein, said insert having longitudinally extending first connectors and said plurality of forms having second connectors positioned in said first cavities for engaging the first connectors to secure the insert in a selected position in a selected one of the first cavities.

20. An apparatus as defined in claim 19 wherein said plurality of modular forms include at least one straight modular form, at least one L-shaped corner modular form and at least one T-shaped modular form.

21. The apparatus defined in claim 19 wherein the forms comprise extruded polymeric material.

22. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape, wherein several of said plurality of modular forms include a removable protective film applied to a surface on the several modular forms for protecting the surface.

23. The apparatus defined in claim 22 wherein the forms comprise extruded polymeric material.

24. A modular form foundation system comprising:

a plurality of interconnectable extruded forms including different cross sectional shapes configured so that said forms can be selectively arranged and interconnected on a construction site to define a customized building foundation shape, said plurality of forms each including an interior side wall section, an exterior side wall section, and opposing end wall sections interconnecting the side wall sections defining cavities that extend along the foundation shapes when assembled, said end wall sections including mating male and female interlocking connectors spaced from said side wall sections wherein several of said plurality of modular forms include a removable protective film applied to a surface thereof for protecting the surface.

25. A modular foundation system as defined in claim 24 wherein said plurality of forms include apertures adapted to interconnect the first-mentioned cavities when positioned in the shape of the customized building foundation, thus adapting the first-mentioned cavities to receive poured concrete, and further including a series of second cavities extending generally parallel the first-mentioned cavities for receiving insulation to form a substantially continuous insulative layer around the foundation shape when interlocked.

26. A modular foundation system as defined in claim 25 including an insert configured to fit within said first-mentioned cavities against one of said opposing end wall sections for covering at least one of said apertures.

27. The modular form defined in claim 24 wherein the forms comprise extruded polymeric material.

28. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape, said plurality of modular forms include opposing end wall sections, with each end wall section having at least three apertures therein configured to allow cross flow of the cement being poured between the first cavities, wherein at least one of said apertures is truncated at an edge of said opposing said end wall sections so as to open downwardly when the forms are arranged and interconnected in the shape of a building foundation.

29. An apparatus for forming customized building foundations, comprising:

a plurality of extruded modular forms configured to be selectively arranged and interconnected in the shape of a customized building foundation, said plurality of forms, when in the shape of the customized building foundation, defining a series of interconnected first cavities extending around the shape for receiving poured concrete and further including a series of second cavities extending generally adjacent the first cavities for receiving insulation to form a substantially continuous insulative layer around the shape; and said modular forms including integrally-extruded walls defining a vertically-extending raceway in one of said first cavities, the walls being continuous and shaped to prevent flow of concrete into the raceway from the first cavities.

* * * * *